US005383394A

United States Patent [19]

Izume

[11] Patent Number: 5,383,394

[45] Date of Patent: Jan. 24, 1995

[54] APPARATUS FOR SUPPLYING INK TO PRINTING MACHINE

[75] Inventor: Masayuki Izume, Kyoto, Japan

[73] Assignee: I. mar Planning, Inc., Kyoto, Japan

[21] Appl. No.: 108,731

[22] PCT Filed: Jan. 8, 1993

[86] PCT No.: PCT/JP93/00017

§ 371 Date: Feb. 16, 1994

§ 102(e) Date: Feb. 16, 1994

[87] PCT Pub. No.: WO93/13944

PCT Pub. Date: Jul. 22, 1993

[30] Foreign Application Priority Data

Jan. 10, 1992 [JP] Japan ..... 4-003239

[51] Int. Cl.[6] ..... B41F 31/14; B41F 31/38

[52] U.S. Cl. ..... 101/350; 101/DIG. 32

[58] Field of Search ..... 101/348, 349, 350, 351, 101/352, 360–365, DIG. 32, 148, 207–210

[56] References Cited

U.S. PATENT DOCUMENTS 4,632,029 12/1986 Simeth ..... 101/348

4,987,831 1/1991 Weder ..... 101/350

FOREIGN PATENT DOCUMENTS 60-38160 2/1985 Japan .

*Primary Examiner*—J. Reed Fisher

*Attorney, Agent, or Firm*—Armstrong, Westerman, Hattori, McLeland & Naughton

[57] ABSTRACT

An apparatus for supplying ink to a printing machine comprising an ink fountain roller and an ink distributing roller supported by a frame so as to be parallel to each other, and a plurality of vibrating rollers divided axially of the rollers and disposed therebetween as arranged at a spacing axially thereof, each of the vibrating rollers being individually positionable alternatively at one of two positions between the rollers so as to be changeable in the state of contact with thereof with the ink fountain roller and the ink distributing roller. A fixed shaft fixed to the frame extends through the interiors of the plurality of tubular vibrating rollers with a predetermined clearance therebetween in the radial direction. A permanent magnet is provided at an inner peripheral portion of each vibrating roller. A magnetic device including an electromagnet is provided on an outer peripheral portion of the fixed shaft inside the vibrating roller. Each vibrating roller is individually shiftable to one of two positions in the state where the permanent magnet of the vibrating roller and the magnetic device of the fixed shaft are opposed to each other with a predetermined clearance therebetween in the radial direction by a change-over of the state of current supply to the electromagnet of each magnetic device.

6 Claims, 3 Drawing Sheets

APPARATUS FOR SUPPLYING INK TO PRINTING MACHINE

TECHNICAL FIELD

The present invention relates to apparatus for supplying ink to printing machines, and more particularly to an apparatus for supplying ink to printing machines which comprises an ink fountain roller, an ink distributing roller and a plurality of vibrating rollers divided axially of these rollers and arranged therebetween, each of the vibrating rollers being individually positionable alternatively at one of two positions between the rollers so as to be changeable in the state of contact thereof with the ink fountain roller and the ink distributing roller.

BACKGROUND ART

Such ink supply apparatus for printing machines are already known in which each of the vibrating rollers is rotatably mounted on the movable end of a pivotal arm. By moving the pivotal arm as by an air cylinder, the vibrating roller is shiftable to a first position in which the roller is in contact with the ink fountain roller and away from the ink distributing roller, or alternatively to a second position in which the vibrating roller is in contact with the ink distributing roller and away from the ink fountain roller.

However, the conventional ink supply apparatus described requires groups of pivotal arms for changing over the position of the vibrating rollers and therefore has the problem of necessitating a large space for the installation of the arrangement.

An object of the present invention is to overcome the above problem and to provide an ink supply apparatus for printing machines which is reduced in the installation space for the vibrating rollers.

DISCLOSURE OF THE INVENTION

The apparatus of the invention for supplying ink to a printing machine comprises an ink fountain roller and an ink distributing roller supported by a frame so as to be parallel to each other, and a plurality of vibrating rollers divided axially of the rollers and disposed therebetween as arranged at a spacing axially thereof, each of the vibrating rollers being individually positionable alternatively at one of two positions between the rollers so as to be changeable in the state of contact thereof with the ink fountain roller and the ink distributing roller, the ink supplying apparatus being characterized in that a fixed shaft fixed to the frame extends through interiors of the plurality of tubular vibrating rollers with a clearance therebetween in the radial direction, a permanent magnet being provided on an inner peripheral portion of each of the vibrating rollers, a magnetic device including an electromagnet being individually provided on an outer peripheral portion of the fixed shaft inside each of the vibrating rollers, each of the vibrating rollers being individually positionable alternatively at one of the two positions in the state where the permanent magnet of the vibrating roller and the magnetic device of the fixed shaft are individually opposed to each other with a predetermined clearance therebetween in the radial direction by the change-over of the state of current supply to the electromagnet of each magnetic device.

The adjacent vibrating rollers may be connected together end-to-end by a flexible tubular portion having a small wall thickness.

The tubular permanent magnet is fixed to the inner peripheral portion of each of the vibrating rollers. The magnetic device comprises the substantially tubular permanent magnet and the electromagnet, the permanent magnet being fixed to the outer peripheral portion of the fixed shaft and being partially cut out, the electromagnet being fixed to the outer peripheral portion of the fixed shaft at the position of the cut-out portion. The position of the vibrating roller may be changed over by a change-over of the state of current supply to the electromagnet of each magnetic device.

Tubular permanent magnets for positioning the vibrating rollers are fixedly provided in the axial direction outside the vibrating rollers at both ends. The vibrating rollers are axially positionable by mutual repellent force between the respective permanent magnets of the vibrating rollers and repellent force from the positioning permanent magnets.

The fixed shaft fixed to the frame extends through the interiors of the plurality of tubular vibrating rollers. Only the permanent magnet and the magnetic device are respectively provided on the inner peripheral portion of each vibrating roller and on the outer peripheral portion of the fixed shaft inside the vibrating roller. Thus, the arrangement described obviates the necessity of providing outside the vibrating rollers a member for changing the positions of the vibrating rollers, such as the conventional pivotal arm. Accordingly, the above arrangement needs only a space for providing the vibrating rollers between the ink fountain roller and the ink distributing roller, and the installation space for the vibrating rollers can be smaller. Further, the vibrating rollers are rotated by friction when the vibrating rollers are in contact with either the ink fountain roller or the ink distributing roller. However, the vibrating rollers and the permanent magnet are not in contact with the fixed shaft and the magnetic device so that the vibrating rollers have very small rotational resistance.

When the adjacent vibrating rollers are connected together end-to-end by a flexible tubular portion of small wall thickness, the tubular portion prevents ingress of the ink into the space between the vibrating rollers. Moreover, the tubular portion is small in wall thickness and flexible, so that the vibrating rollers can be changed over individually between the two positions without any impediment.

The tubular permanent magnet is fixed to the inner peripheral portion of each of the vibrating rollers. The magnetic device has the substantially tubular permanent magnet and the electromagnet, the permanent magnet being fixed to the outer peripheral portion of the fixed shaft and being partially cut out, the electromagnet being fixed to the outer peripheral portion of the fixed shaft at the position of the cut-out portion. The positions of the vibrating rollers may be changed over by the change-over of the state of current supply to the electromagnet. Therefore, the current supply to the electromagnet is stoped when the vibrating roller is shifted from one of the two positions to the other position. Consequently, heat generated by the electromagnet can be reduced.

The permanent magnets for positioning the vibrating rollers are fixedly provided in the axial direction outside the vibrating rollers at both ends. The vibrating rollers are axially positioned by mutual repellent force between the respective permanent magnets of the vibrating rollers and repellent force from the positioning permanent magnets. Therefore, the vibrating rollers can be positioned without any contact to each other in the axial direction. Consequently, rotational resistance of the vibrating rollers can be reduced further.

BEST MODE OF CARRYING OUT THE INVENTION

Embodiments of the present invention will be described below with reference to the drawings.

Figure 1:
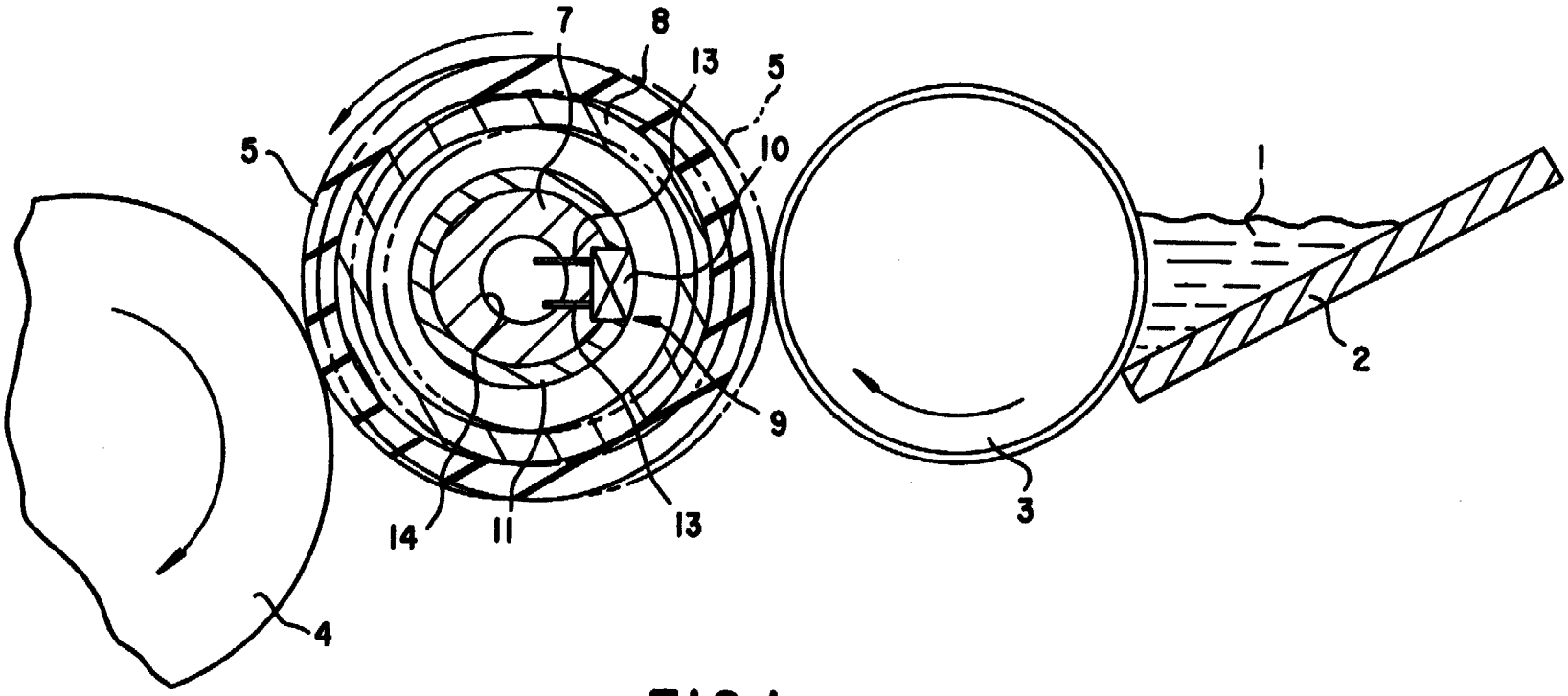
FIG. 1 is a view in vertical section showing an apparatus embodying the invention for supplying ink to printing machines.
Figure 2:
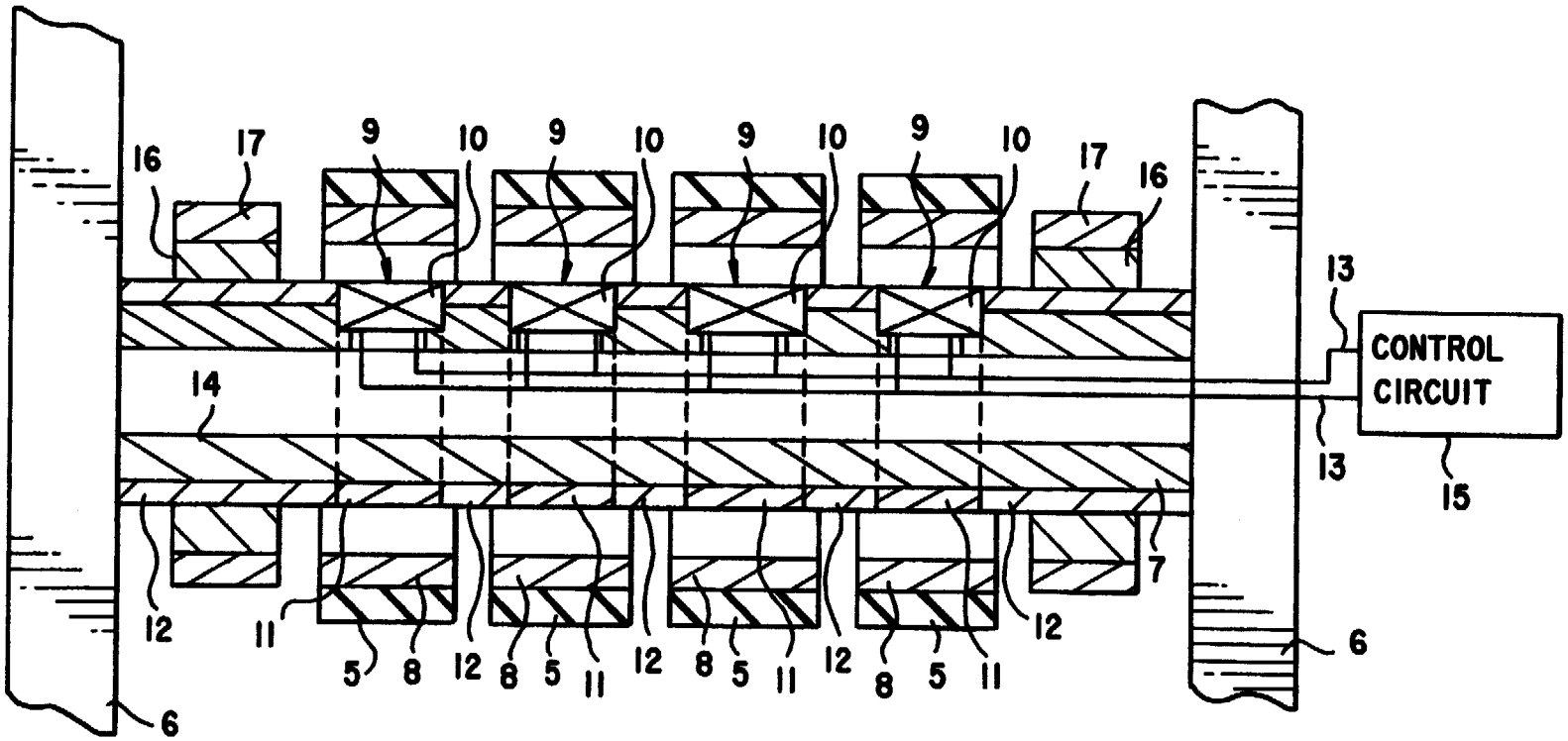
FIG. 2 is a view in horizontal section of vibrating rollers in the apparatus of FIG. 1.

FIG. 1 and FIG. 2 show one embodiment of an apparatus for supplying ink to a printing machine.

An ink fountain roller 3 is disposed close to a plate (doctor blade) 2 providing the bottom of an ink fountain 1 and adapted to control the amount of ink. Between the fountain roller 3 and the first ink distributing roller 4 among other ink distributing rollers, a plurality of vibrating rollers 5 divided axially of these rollers are arranged at a spacing axially thereof. The fountain roller 3 and the distributing roller 4 are rotatably supported by a frame 6 of the printing machine so as to be parallel to each other, and are rotated in the direction of arrows in FIG. 1, each at a predetermined speed as timed with the other, by an unillustrated drive device.

The vibrating rollers are provided in the form of a hollow cylinder made of rubber and the like and has a large wall thickness. A fixed shaft 7 is fixed to the frame 6 so as to be parallel to the ink fountain roller 3 and the ink distributing roller 4. The fixed shaft 7 extends through the interiors of the vibrating rollers with a clearance in the radial direction. A tubular permanent magnet 8 is fixed to an inner peripheral portion of each of the vibrating rollers 5. The fixed shaft 7 is circular in cross section and is fixed to the frame 6 at both ends. A magnetic device 9 is provided individually on an outer peripheral portion of the fixed shaft 7 inside each of the vibrating rollers 5. The magnetic device 9 comprises an electromagnet 10 and a substantially tubular permanent magnet 11. A sleeve 12 and the permanent magnet 11 having the same diameter are alternately set around the fixed shaft 7 so that the permanent magnet 11 is positioned and fixed. The portion of the permanent magnet 11 facing the ink fountain roller is cut out and the electromagnet is fixed to the outer peripheral portion of the fixed shaft at the position of the cut-out portion. Accordingly, the permanent magnet 11 and the electromagnet 10 together form the shape of tube. The outer diameter of the magnetic device 9 fixed to the fixed shaft 7 is quite smaller than the inner diameter of the permanent magnet 8 fixed to the vibrating roller 5 and a clearance is provided therebetween in the radial direction. Thus, the vibrating rollers 5 are movable freely with respect to the fixed shaft 7. Electric wires 13 of the electromagnet 10 extend to the outside of the fixed shaft 7 through a bore 14 formed in the fixed shaft 7 so as to be connected to a control circuit 15. A support member 16 in the form of a hollow cylinder and having a large wall thickness is fixed to the outer peripheral surface of the sleeve 12 between the vibrating roller 5 and the frame 6 at each end. A tubular permanent magnet 17 for positioning the vibrating rollers is fixed to the outer peripheral surface of the support member 16, the permanent magnet 17 having the same diameter as the permanent magnet 8 fixed to the vibrating roller 5. Each of the permanent magnets 8, 11, 17 has magnetic poles on the inner peripheral surface and on the outer peripheral surface. Polarities of these permanent magnets are determined so that the permanent magnets of the vibrating rollers give repellent force to each other and repellent force is received from the permanent magnet 11 of the magnetic device 9 and the positioning permanent magnet 17. For example, the inner peripheral surface of the permanent magnet 8 fixed to the vibrating roller 5 and that of the positioning permanent magnet 17 are magnetized as N poles and the outer peripheral surface of the permanent magnet 8 fixed to the vibrating roller 5 and that of the positioning permanent magnet 17 are magnetized as S poles. The outer peripheral surface of the permanent magnet 11 of the fixed shaft 9 is magnetized as N pole and the inner surface thereof is magnetized as S pole.

Each of the vibrating rollers 5 is positioned in the axial direction so as to be arranged outside the corresponding magnet device 9 by means of mutual repellent force between the respective permanent magnets 8 of the vibrating rollers 5 and repellent force from the positioning permanent magnets 17. The permanent magnet 8 and the magnetic device 9 are opposed to each other with a predetermined clearance therebetween in the radial direction. Under this circumstance, the positions of the vibrating rollers 5 can be shifted to a first position where the vibrating rollers 5 are in contact with the fountain roller 3 and away from the distributing roller 4, or alternatively to a second position where the vibrating rollers 5 are in contact with the distributing roller 4 and away from the fountain roller 4 by changing over the state of current supply to the electromagnet 10 as follows. The electromagnet 10 can be changed over either to the deenergized state (OFF state) or to the energized state (ON state) where the outer periphery thereof is magnetized as N pole and the inner periphery thereof is magnetized as S pole. When the electromagnet 10 is switched to the OFF state, the vibrating rollers are shifted to the second position so as to be in contact with the distributing roller 4 as indicated in a solid line in FIG. 1. At this time, repellent force of the permanent magnet 8 fixed to the vibrating roller 5 and that of the permanent magnet 11 fixed to the magnetic device 9 are in proportion to pressure from the distributing roller 4. Both the vibrating rollers 5 and the permanent magnet 8 are held to be away from both the magnetic device 9 of the fixed shaft 7 and the sleeve 12. The vibrating rollers 5 are rotated in the direction of arrow in FIG. 1 by the force of friction between the rollers 5 and the distributing roller 4. When the electromagnet 10 is switched to the ON state, the permanent magnet 8 fixed to the vibrating roller 5 receives large repellent force directed toward the fountain roller 3 from the electromagnet 10 so that the vibrating roller 5 moves toward the fountain roller 3. Consequently, as illustrated in a broken line in FIG. 1, the vibrating roller 5 is shifted to the first position into pressing contact with the fountain roller 3. At this time, repellent force of the permanent magnet 8 fixed to the vibrating roller 5, that of the permanent magnet 11 of the magnetic device and that of the electromagnet 10 are together in proportion with pressure from the fountain roller 3. Both the vibrating roller 5 and the permanent magnet 8 are held to be away from both the magnetic device 9 of the fixed shaft 7 and sleeve 12. The vibrating roller 5 is rotated in the direction of arrow in FIG. 1 by the force of friction between the roller 5 and the fountain roller 3. When the electromagnet 10 is switched to the OFF state, the vibrating roller 5 returns to the second position. When the vibrating roller 5 is in the first position and when it is in the second position, the vibrating roller 5 and the permanent magnet 8 are held to be in the state of noncontact with the fixed shaft 7 and the magnetic device 9 so that the vibrating roller 5 has very small rotational resistance.

The ink within the ink fountain roller 1 flows out onto the surface of the fountain roller 3 through a clearance between the control plate 2 and the roller 3. At this time, the thickness of film of the ink, i.e., the amount of ink, to be supplied to the surface of the fountain roller 3 can be controlled by adjusting the clearance between the roller 3 and the control plate 2. The ink appearing on the surface of the fountain roller 3 is transferred to the vibrating roller 5 as shifted to the first position. The ink transferred to the vibrating roller 5 is transferred to the distributing roller 4 as shifted to the second position. The period of time during which each vibrating roller 5 is located as shifted in the first position as well as in the second position is controlled by the control circuit 15, whereby the amount of ink to be supplied to the particular position with respect to the widthwise direction thereof.

Figure 3:
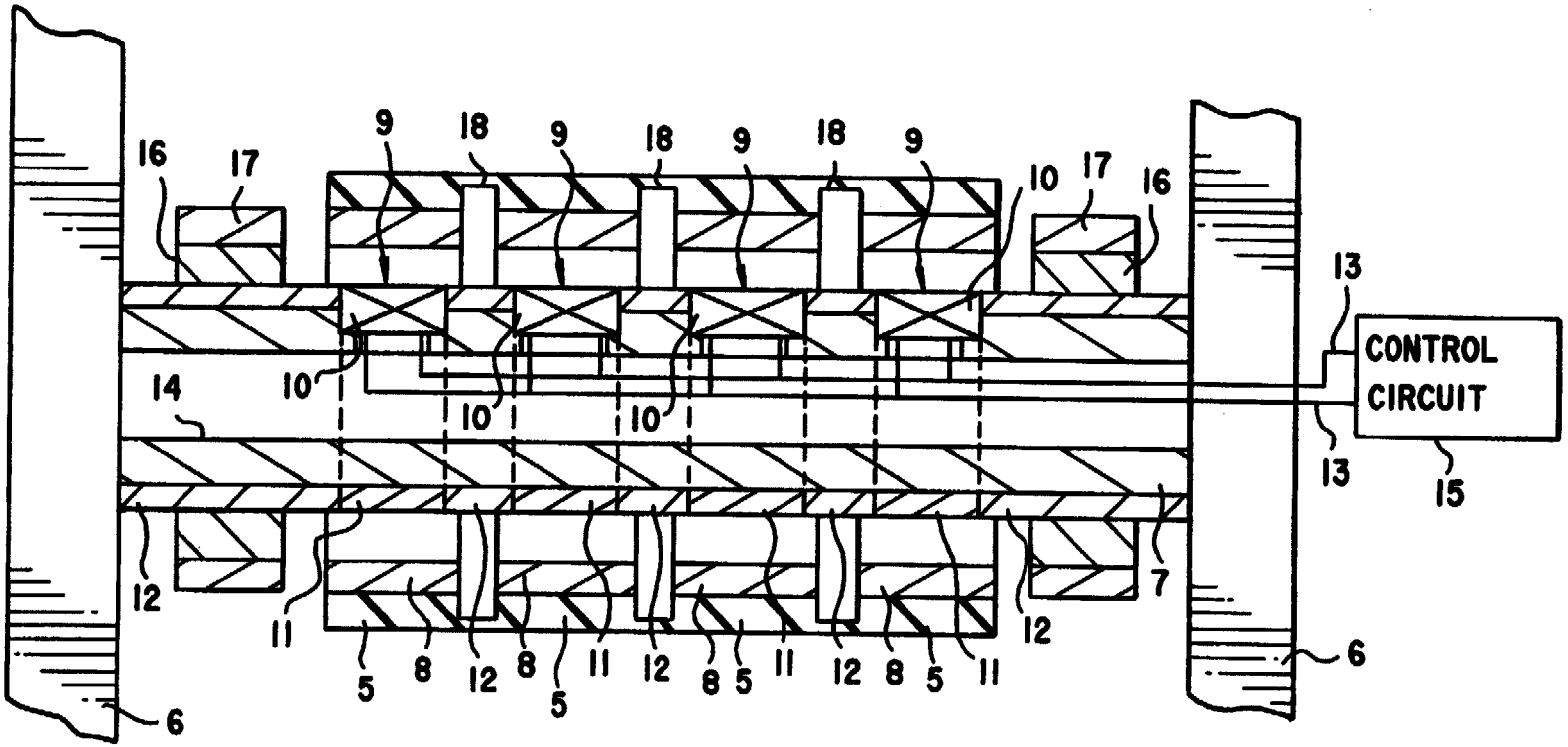
FIG. 3 is a view in horizontal section showing another embodiment of the apparatus for supplying ink to printing machines.

FIG. 3 shows another embodiment different from the above. Throughout the drawings, like parts are designated by like reference numerals.

In this case, the vibrating rollers 5 adjacent to each other are connected together end-to-end by a flexible tubular portion 18 of small wall thickness around the outer periphery. The flexible tubular portion 18 may be formed integrally with the vibrating roller 5, or a plurality of hollow cylindrical rubber members of large wall thickness may be bonded to the inner side of an elongated flexible rubber tube to thereby form vibrating rollers 5 and flexible tubular portions 18. Since the adjacent vibrating rollers 5 are connected end-to-end by the tubular portion 18, no ink will ingress into the space between the vibrating rollers 5. Moreover, the tubular portion 18 is small in wall thickness and flexible, so that each vibrating roller 5 can be individually changed over between the first position and the second position without any impediment. The embodiment having the above structure is otherwise the same as the first embodiment.

The components of the ink supply apparatus are not limited in construction to those of the foregoing embodiments but can be suitably modified. Although only one tubular permanent magnet 8 is provided to the vibrating roller 5, for example, a plurality of block-like permanent magnets can be arranged in the circumferential direction of the vibrating roller 5. The same arrangement can apply to the permanent magnet 11 of the electromagnet 10 as well as to the positioning permanent magnet 17. Further, according to the above embodiment, the magnetic device 9 of the fixed shaft 7 has the electromagnet 10 and the permanent magnet 11. When the vibrating roller 5 is shifted to the second position, the electromagnet 10 comes to be de-energized so that the present invention has the advantage of reducing the generation of heat from the electromagnet 10. However, only the electromagnet can be provided as the magnetic device of the fixed shaft so that the vibrating roller 5 can be changed over between the two positions by the change-over of the state of current supply for reversing the polarities of the electromagnet. Furthermore, although the vibrating roller 5 is shiftable between the position where it is in contact with the fountain roller 3 and away from the distributing roller 4 and the position where it is in contact with the distributing roller 4 and away from the fountain roller 3 by the change-over according to the above embodiments, the present invention is applicable to ink supplying apparatus wherein the vibrating roller always in contact with the distributing roller is shiftable to a position where the vibrating roller is in contact with the fountain roller or alternatively to a position where it is away from the fountain roller as recited in Unexamined Japanese Patent Publication HEI 2-301439.

INDUSTRIAL APPLICABILITY

The apparatus of the invention for supplying ink to a printing machine is suitable for use in printing machines which comprises an ink fountain roller, an ink distributing roller and a plurality of vibrating rollers divided axially of these rollers and arranged therebetween, each of the vibrating rollers being individually positionable alternatively at one of two positions between the rollers so as to be changeable in the state of contact thereof with the ink fountain roller and the ink distributing roller.

What is claimed is:

1. An apparatus for supplying ink to a printing machine comprising an ink fountain roller and an ink distributing roller supported by a frame so as to be parallel to each other, and a plurality of vibrating rollers divided axially of the ink fountain roller and the ink distributing roller and disposed therebetween as arranged at a spacing axially thereof, each of the vibrating rollers being individually positionable alternatively at one of two positions between the ink fountain roller and the ink distributing roller so as to be changeable in the state of contact thereof with the ink fountain roller and the ink distributing roller; characterized in that a fixed shaft fixed to the frame extends through interiors of a plurality of tubular portions of the vibrating rollers with a clearance therebetween in the radial direction, a permanent magnet being provided on an inner peripheral portion of each of the vibrating rollers, a magnetic device including an electromagnet being provided on an outer peripheral portion of the fixed shaft inside each vibrating roller, each of the vibrating rollers being individually positionable alternatively at one of the two positions in the state where the permanent magnet of each vibrating roller and the magnetic device of the fixed shaft are individually opposed to each other with a predetermined clearance therebetween in the radial direction by a change-over of the state of current supply to the electromagnet of each magnetic device.

2. An apparatus for supplying ink to a printing machine as defined in claim 1 wherein the vibrating rollers adjacent to each other are connected together end-to-end by a flexible tubular portion having a small wall thickness.

3. An apparatus for supplying ink to a printing machine as defined in claim 1 wherein a tubular permanent magnet is fixed to the inner peripheral portion of each of the vibrating rollers, the magnetic device having a substantially tubular permanent magnet and the electromagnet, the permanent magnet of the magnetic device being fixed to the outer peripheral portion of the fixed shaft and being partially cut out, the electromagnet being fixed to the outer peripheral portion of the fixed shaft at the position of the cut-out portion, the position of the vibrating roller being shiftable by the change-over of the state of current supply to the electromagnet.

4. An apparatus for supplying ink to a printing machine as defined in claim 3 wherein permanent magnets for positioning the vibrating rollers are provided axially outside the vibrating rollers at both ends, the vibrating rollers being positioned in the axial direction by mutual repellent force between the respective permanent magnets of the vibrating rollers and repellent force from the positioning permanent magnets.

5. An apparatus for supplying ink to a printing machine as defined in claim 2 wherein the permanent magnet is fixed to the inner peripheral portion of each of the vibrating rollers, the magnetic device having a substantially tubular permanent magnet and the electromagnet, the permanent magnet of the magnetic device being fixed to the outer peripheral portion of the fixed shaft and being partially cut out, the electromagnet being fixed to the fixed shaft at the position of the cut-out portion, the position of the vibrating roller being shiftable by the change-over of the state of current supply to the electromagnet.

6. An apparatus for supplying ink to a printing machine as defined in claim 5 wherein positioning permanent magnets are provided axially outside the vibrating rollers at both ends, the vibrating rollers being positioned in the axial direction by mutual repellent force between the respective permanent magnets of the vibrating rollers and repellent force from the positioning permanent magnets.

* * * * *